US009746810B2

(12) United States Patent
Shirasaka

(10) Patent No.: US 9,746,810 B2
(45) Date of Patent: Aug. 29, 2017

(54) SHEET HUMIDIFICATION APPARATUS, SHEET HUMIDIFICATION METHOD AND IMAGE FORMATION SYSTEM

(71) Applicant: Konica Minolta, Inc., Tokyo (JP)

(72) Inventor: Satoru Shirasaka, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/082,428

(22) Filed: Mar. 28, 2016

(65) Prior Publication Data

US 2016/0299468 A1 Oct. 13, 2016

(30) Foreign Application Priority Data

Apr. 9, 2015 (JP) ..... 2015-080221

(51) Int. Cl.
*G03G 15/20* (2006.01)
*G03G 15/00* (2006.01)

(52) U.S. Cl.
CPC . *G03G 15/6573* (2013.01); *G03G 2215/0067* (2013.01)

(58) Field of Classification Search
USPC ..... 399/320, 341, 390, 406, 407
See application file for complete search history.

(56) References Cited

U.S. PATENT DOCUMENTS 6,052,553 A * 4/2000 Acquaviva ..... G03G 15/6573 399/341
7,460,824 B2 * 12/2008 Nakajima ..... G03G 15/6576 399/341

FOREIGN PATENT DOCUMENTS

JP 2012-024953 A 2/2012
JP 2014-091605 A 5/2014

* cited by examiner

*Primary Examiner* — Hoan Tran
(74) *Attorney, Agent, or Firm* — Baker & Hostetler LLP

(57) ABSTRACT

A sheet humidification apparatus includes a pair of humidification rollers, a water supply section, and a control section configured to control humidification of the humidification rollers and water supply of the water supply section, and the control section refers to a contacting period between the humidification rollers to control the water supply such that a second water supply amount from the water supply section to the second humidification member is smaller than a first water supply amount from the water supply section to the first humidification member.

13 Claims, 7 Drawing Sheets

| PARAMETER \ INFLUENCE | | WATER MOVEMENT AMOUNT | WATER REMOVAL AMOUNT (WATER REDUCTION AMOUNT) | WATER SUPPLY AMOUNT |
|---|---|---|---|---|
| CONTACT PRESSURE OF HUMIDIFICATION ROLLER (NON-SHEET PASSAGE PERIOD) | LARGE | LARGE | — | — |
| | SMALL | SMALL | — | — |
| CONTACT PERIOD OF HUMIDIFICATION ROLLER (NON-SHEET PASSAGE PERIOD) | LARGE | LARGE | — | — |
| | SMALL | SMALL | — | — |
| ROTATION SPEED OF HUMIDIFICATION ROLLER (NON-SHEET PASSAGE PERIOD) | LARGE | LARGE | — | — |
| | SMALL | SMALL | — | — |
| DEGREE OF DIPPING OF WATER SUPPLY ROLLER | DEEP | LARGE | — | LARGE |
| | NOT DEEP | SMALL | — | SMALL |
| CONTACT PRESSURE OF DRAINING ROLLER | LARGE | SMALL | LARGE | SMALL |
| | SMALL | LARGE | SMALL | LARGE |
| HUMIDIFICATION AMOUNT OF SHEET | LARGE | — | SMALL | — |
| | SMALL | — | LARGE | — |

FIG. 7

SHEET HUMIDIFICATION APPARATUS, SHEET HUMIDIFICATION METHOD AND IMAGE FORMATION SYSTEM

CROSS REFERENCE TO RELATED APPLICATIONS

This application is entitled to and claims the benefit of Japanese Patent Application No. 2015-080221, filed on Apr. 9, 2015, the disclosure of which, including the specification, drawings and abstract, is incorporated herein by reference in its entirety.

BACKGROUND OF THE INVENTION

1. Field of the Invention

The present invention relates to a sheet humidification apparatus that humidifies a sheet on which an image is formed, a sheet humidification method and an image formation system.

2. Description of Related Art

In electrophotographic image forming apparatuses such as a copier, a printer, a facsimile machine, and multifunctional devices having such functions, thermal fixation processes are performed to stabilize the toner image on the sheet. In the fixation processes, the moisture of the sheet is reduced.

As a result, the sheet may be curled or deformed into a wavy shape. In addition to the curl, the sheet may also have static electricity, or heat in the fixation processes. Consequently, jam may be easily caused, and the subsequent processes may be negatively influenced.

To solve the above-mentioned problems, a configuration for humidifying the sheet to be subjected to the fixation process has been proposed. Specifically, for the purpose of removing the curl of the sheet, discharging the sheet, and cooling down the sheet, the sheet is conveyed in a sandwiching manner with moisturized humidification rollers to humidify the sheet. In addition to the configuration using the humidification roller, a method of spraying water vapor to the sheet has also been proposed.

Variations and approaches of such image forming apparatuses are disclosed in Japanese Patent Application Laid-Open No. 2014-091605 and Japanese Patent Application Laid-Open No. 2012-024953.

Japanese Patent Application Laid-Open No. 2014-091605 discloses a mechanism for humidifying sheets during horizontal conveyance in an image formation system in which sheets are conveyed in the horizontal direction. Here, the distance between a water supply section and a humidification roller is set to the same distance between upper and lower humidification rollers to equalize the water amount between the upper and lower humidification rollers.

However, as a result of researches, the present inventors found that movement of the water from the upper humidification roller to the lower humidification roller is caused at the timing when the upper and lower humidification rollers make contact with each other. In addition, it was found that the difference in water amount between the upper and lower humidification rollers results in difference in humidification amount between the upper and lower surfaces of the sheet, thus causing sheet curl.

In addition, Japanese Patent Application Laid-Open No. 2012-024953 discloses a mechanism for adjusting the humidification amount by humidification rollers disposed on left and right sides (horizontal positions) during vertical conveyance of sheets. Such a mechanism can function as it is when the humidification rollers are disposed at the same height in the horizontal direction, but cannot be applied to the humidification rollers disposed on the upper and lower sides for conveying sheets in the horizontal direction.

While the movement of the water between a pair of humidification rollers disposed on the upper and lower sides for horizontally conveying sheets is mentioned in the above-mentioned description, the water also moves between the humidification rollers even in the case where a vertical height difference exists between the humidification rollers, for example, in the case where sheets are conveyed obliquely upward or oblique downward. It is to be noted that, even when humidification members having forms other than roller forms are employed, the above-mentioned problems are caused at a pair of humidification members configured to humidify a sheet while sandwiching the sheet.

SUMMARY OF THE INVENTION

To solve the above-mentioned problems, an object of the present invention is to provide a sheet humidification apparatus and a sheet humidification method which can reduce a difference in the humidification amount between both sides of a sheet when a pair of humidification members having a height difference therebetween and configured to humidify a sheet while sandwiching the sheet are used.

Solution to Problem

A mode of the present invention for solving the above-mentioned problems is as follows.

(1) To achieve at least one of the abovementioned object, a sheet humidification apparatus reflecting one aspect of the present invention includes: a pair of humidification members configured to humidify a sheet while sandwiching the sheet; a water supply section configured to supply water to the humidification members; and a control section configured to control humidification of the sheet by the humidification member and water supply to the humidification members by the water supply section, wherein, when one of the humidification members which is disposed on an upper side in a vertical direction is a first humidification member and the other of the humidification members disposed on a lower side in the vertical direction is a second humidification member, the control section refers to a contacting period during which the humidification members are in contact with each other, and controls the water supply such that a second water supply amount from the water supply section to the second humidification member is smaller than a first water supply amount from the water supply section to the first humidification member.

Further, in a sheet humidification method reflecting another aspect of the present invention in a sheet humidification apparatus, the humidification apparatus includes a pair of humidification members configured to humidify a sheet while sandwiching the sheet; a water supply section configured to supply water to the humidification members; and a control section configured to control humidification of the sheet by the humidification member and water supply to the humidification members by the water supply section, the sheet humidification method including: when one of the humidification members which is disposed on an upper side in a vertical direction is a first humidification member and the other of the humidification members disposed on a lower side in the vertical direction is a second humidification member, referring to a contacting period during which the humidification members are in contact with each other to control the water supply section such that a second water supply amount from the water supply section to the second humidification member is smaller than a first water supply amount from the water supply section to the first humidification member.

(2) In the above-mentioned (1), desirably, the control section calculates a water movement amount, the water movement amount being an amount of water which moves from the first humidification member to the second humidification member when the first humidification member and the second humidification member are in contact with each other; calculates the first water supply amount in a modified state by adding the water movement amount to the first water supply amount in an unmodified state; and calculates the second water supply amount in a modified state by subtracting the water movement amount from the second water supply amount in an unmodified state.

(3) In the above-mentioned (2), desirably, the control section calculates the water movement amount by referring to a contact pressure between the first humidification member and the second humidification member when the first humidification member and the second humidification member are in contact with each other.

(4) In the above-mentioned (2) to (3), desirably, the control section calculates the water movement amount by referring to a movement speed at a contact position between the first humidification member and the second humidification member when the first humidification member and the second humidification member are in contact with each other.

(5) In the above-mentioned (2) to (4), desirably, the control section calculates the water movement amount by referring to a period until the sheet reaches the first humidification member and the second humidification member as the contacting period when the first humidification member and the second humidification member are in contact with each other.

(6) In the above-mentioned (2) to (5), desirably, the control section calculates the water movement amount by referring to a non-sheet passage period between the sheet and a next sheet as the contacting period when the first humidification member and the second humidification member are in contact with each other.

(7) In the above-mentioned (1) to (6), desirably, a first water storage section configured to retain water which is supplied to the first humidification member by the water supply section; and a second water storage section configured to retain water which is supplied to the second humidification member by the water supply section, in which: the water supply section includes a first water supply roller configured to supply the water to the first humidification member through a surface which is rotated and partially dipped in the first water storage section, and a second water supply roller configured to supply the water to the second humidification member through a surface which is rotated and partially dipped in the second water storage section; and the control section controls the first water supply amount by controlling a depth of the first water supply roller dipped in the first water storage section from a water surface of the first water storage section, and controls the second water supply amount by controlling a depth of the second water supply roller dipped in the second water storage section from a water surface of the second water storage section.

(8) In the above-mentioned (1) to (7), desirably, the water supply section includes a first water supply roller configured to supply the water to the first humidification member, and a second water supply roller configured to supply the water to the second humidification member; the sheet humidification apparatus further includes a first draining section configured to regulate an amount of the water supplied from the first water supply roller to the first humidification member by making contact with the first water supply roller to remove a part of the water held in the first water supply roller, and a second draining section configured to regulate an amount of the water supplied from the second water supply roller to the second humidification member by making contact with the second water supply roller to remove a part of the water held in the second water supply roller; and the control section controls the first water supply amount by controlling a distance or a pressure of the first draining section when the first draining section makes contact with the first water supply roller, and controls the second water supply amount by controlling a distance or a pressure of the second draining section when the second draining section makes contact with the second water supply roller.

(9) In the above-mentioned (1) to (7), desirably, the control section calculates a water reduction amount which is an amount of the water reduced from the first humidification member and the second humidification member by humidification of the sheet when the first humidification member and the second humidification member are in contact with the sheet, and calculates the first water supply amount and the second water supply amount by referring to the water reduction amount.

In the above-mentioned sheet humidification method, desirably, a water movement amount is calculated, the water movement amount being an amount of water which moves from the first humidification member to the second humidification member when the first humidification member and the second humidification member are in contact with each other; the first water supply amount in a modified state is calculated by adding the water movement amount to the first water supply amount in an unmodified state; and the second water supply amount in a modified state is calculated by subtracting the water movement amount from the second water supply amount in an unmodified state.

In addition, to achieve at least one of the abovementioned objects, an image formation system reflecting another aspect of the present invention includes: an image forming apparatus including an image forming section configured to form an image on a sheet, and a fixing section configured to thermally fix the image formed by the image forming section; and the sheet humidification apparatus according to claim 1 configured to perform humidification on the sheet on which the image is thermally fixed by the fixing section.

In the above-mentioned image formation system, desirably, the control section calculates a water movement amount, the water movement amount being an amount of water which moves from the first humidification member to the second humidification member when the first humidification member and the second humidification member are in contact with each other; calculates the first water supply amount in a modified state by adding the water movement amount to the first water supply amount in an unmodified state; and calculates the second water supply amount in a modified state by subtracting the water movement amount from the second water supply amount in an unmodified state.

BRIEF DESCRIPTION OF DRAWINGS

FIG. 7 is an explanatory diagram for determination of an operation of the sheet humidification apparatus of the embodiment of the present invention.

DETAILED DESCRIPTION

In the following, an embodiment of the present invention will be described in detail with reference to the accompanying drawings. Here, the embodiment will be described in detail with reference to image formation system 1 including sheet humidification apparatus 200.

[Configurations of Image Formation System and Sheet Humidification Apparatus]

With reference to FIGS. 1 to 4, a configuration of image formation system 1 including sheet humidification apparatus 200 according to the present embodiment will be described.

Figure 1:
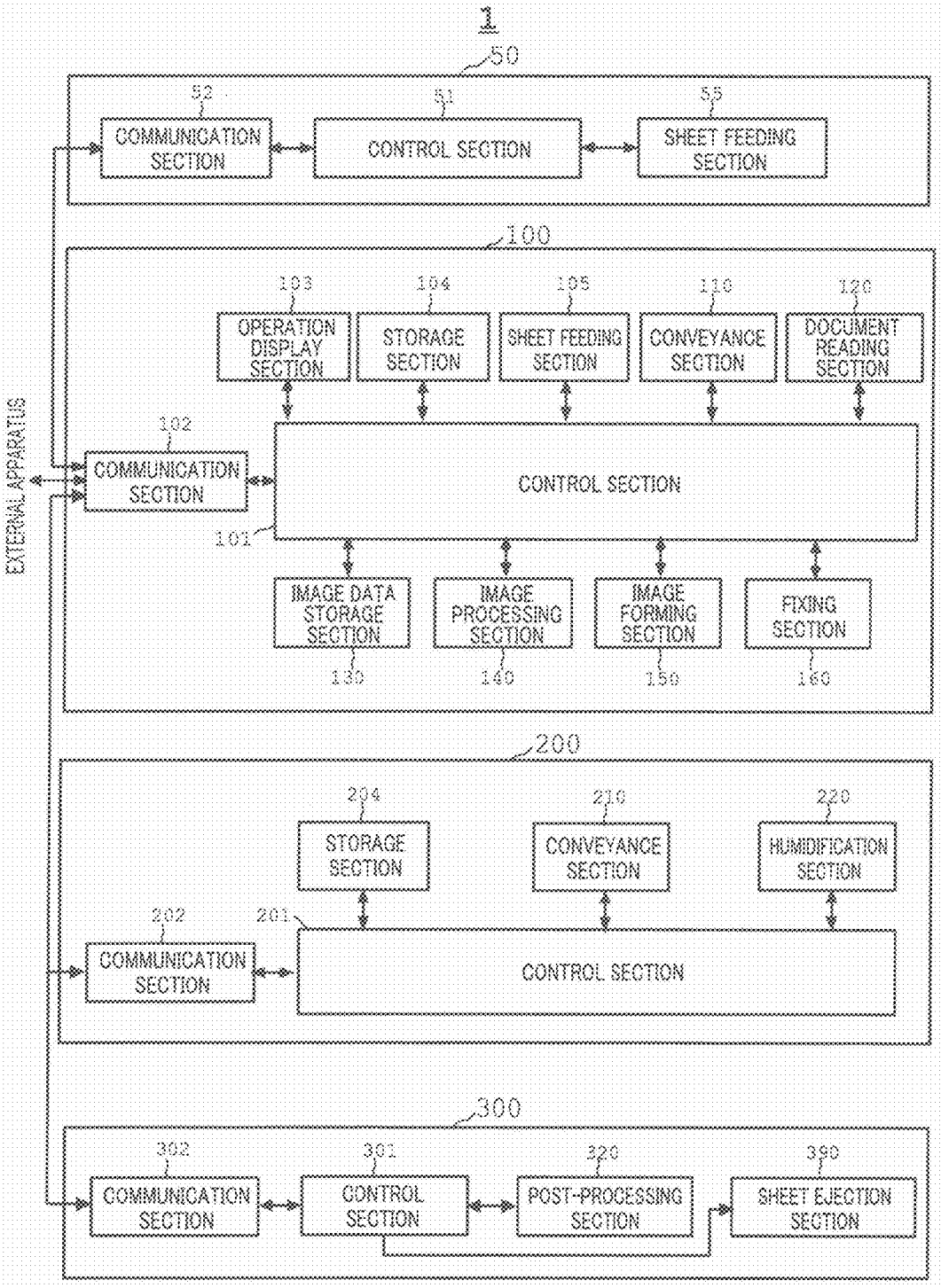
FIG. 1 illustrates a configuration of a sheet humidification apparatus of an embodiment of the present invention.
Figure 2:
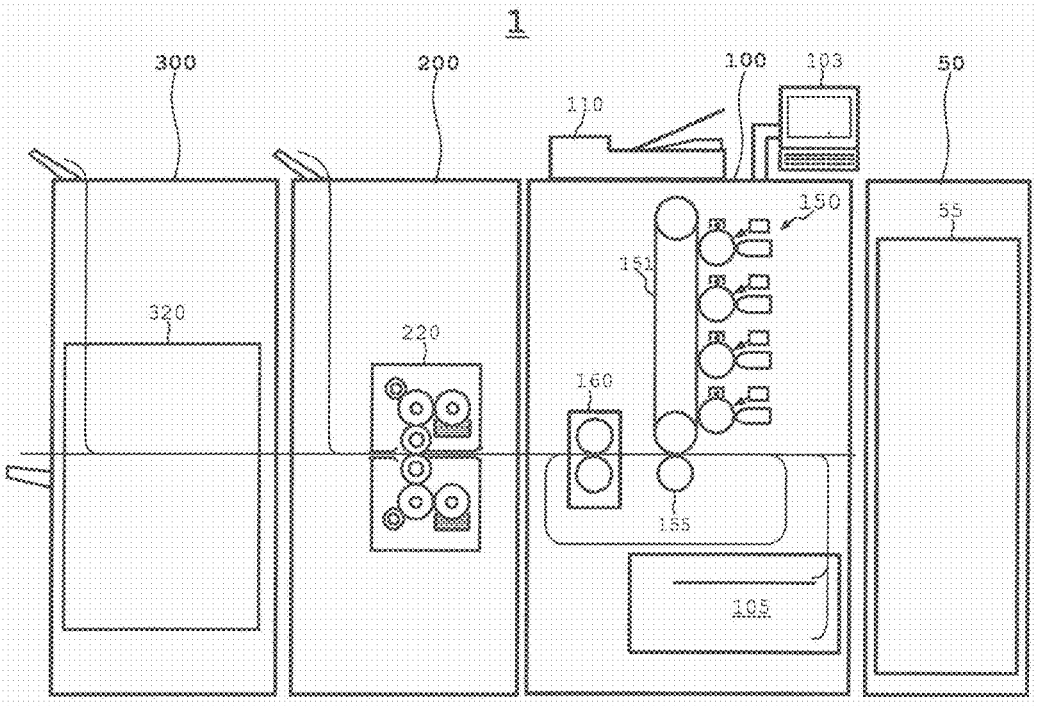
FIG. 2 illustrates a configuration of the sheet humidification apparatus of the embodiment of the present invention.

As illustrated in FIG. 1 and FIG. 2, image formation system 1 includes sheet feeding apparatus 50, image forming apparatus 100, sheet humidification apparatus 200, and after-treatment apparatus 300. Sheet feeding apparatus 50 includes control section 51, communication section 52 and sheet feeding section 55. Here, control section 51 performs a control relating to sheet feeding. Communication section 52 communicates with other apparatuses. Under the control of control section 51, sheet feeding section 55 feeds a sheet toward sheet image forming apparatus 100.

Image forming apparatus 100 includes control section 101, communication section 102, operation display section 103, storage section 104, sheet feeding section 105, conveyance section 110, document reading section 120, image data storage section 130, image processing section 140, image forming section 150, and fixing section 160. A sheet on which an image has been formed in image forming apparatus 100 is conveyed toward the succeeding apparatuses.

Here, control section 101 controls each section in image forming apparatus 100, and the entire image formation system. Communication section 102 communicates with other apparatuses connected thereto. Operation display section 103 informs control section 101 of an operation input signal corresponding to an operation input by an operator, and performs notifications, warnings, and status display of image forming apparatus 100. Storage section 104 stores a control program and various kinds of setting data, and serves as a work area of the control program. Sheet feeding section 105 feeds stored sheets toward image forming section 150. Conveyance section 110 conveys a fed sheet on which to form an image at a predetermined speed. Document reading section 120 scans a document and generates image data. Image data storage section 130 stores various kinds of data and image data for image formation. Image processing section 140 executes various kinds of image processes required for image formation. Image forming section 150 executes printing through image creation, transferring, and fixation (hereinafter referred to as "image formation") on the basis of an image formation command and image data after image processing. With heat and pressure, fixing section 160 stabilizes an image transferred on the sheet.

Sheet humidification apparatus 200 is provided at a position succeeding image forming apparatus 100. Sheet humidification apparatus 200 includes control section 201, communication section 202, conveyance section 210, and humidification section 220. It is to be noted that the sheet conveyed in sheet humidification apparatus 200 is conveyed toward after-treatment apparatus 300 provided at a position succeeding sheet humidification apparatus 200. While sheet humidification apparatus 200 as an independent apparatus is disposed on the downstream side of image forming apparatus 100, sheet humidification apparatus 200 may be disposed inside image forming apparatus 100, or may be disposed inside after-treatment apparatus 300 described later.

Here, control section 201 controls each section of sheet humidification apparatus 200. Communication section 202 communicates with other apparatuses connected thereto. Conveyance section 210 conveys a sheet from image forming apparatus 100 on which an image has been formed in the horizontal direction at a predetermined speed. Under the control of control section 201, humidification section 220 performs humidification on the sheet conveyed in the horizontal direction.

After-treatment apparatus 300 is provided at a position succeeding image forming apparatus 100 and sheet humidification apparatus 200. After-treatment apparatus 300 includes control section 301, communication section 302, post-processing section 320, and sheet ejection section 390. Here, control section 301 controls each section of after-treatment apparatus 300. Communication section 302 communicates with other apparatuses connected thereto. Post-processing section 320 performs various kinds of post-processes on a sheet. Sheet ejection section 390 ejects the sheet to a predetermined outlet.

It is to be noted that the above-mentioned functions, components and connections of sheet feeding apparatus 50, image forming apparatus 100, sheet humidification apparatus 200, after-treatment apparatus 300 (see FIGS. 1 and 2) are merely an example, and are not limited thereto. Here, humidification section 220 which is a principal part of sheet humidification apparatus 200 has an exemplary configuration illustrated in FIG. 3. Here, a sheet is conveyed in the horizontal direction, and a pair of humidification rollers is disposed on the upper and lower sides of the sheet. First humidification roller 225*a* is disposed on the upper side of the sheet, and second humidification roller 225*b* is disposed on the lower side of the sheet.

It is to be noted that, in the present embodiment, first humidification roller 225*a* and second humidification roller 225*b* are described as specific examples of a humidification member. It should be noted that humidification members which do not have a roller shape may be used as a pair of humidification members which humidify the sheet while sandwiching the sheet.

Here, first water storage section 222*a* is a water tank for retaining water W which is used when the sheet is humidified from the upper side. First water supply roller 223*a*1 takes up the water while being partially dipped in first water storage section 222*a*. First water supply roller 223*a*2 makes contact with first water supply roller 223*a*1, and passes on and supplies the water taken up from first water storage section 222*a* by first water supply roller 223*a*1 to first humidification roller 225*a*. First humidification roller 225*a* performs humidification from the upper surface side of the sheet with use of the water supplied from first water storage section 222*a* through first water supply roller 223*a*1 and first water supply roller 223*a*2.

In addition, second water storage section 222*b* is a water tank for retaining water W which is used when the sheet is humidified from the lower side. Second water supply roller 223*b*1 takes up the water while being dipped in second water storage section 222*b*. Second water supply roller 223*b*2 makes contact with second water supply roller 223*b*1, and passes on and supplies the water taken up from second water storage section 222*b* by second water supply roller 223*b*1 to second humidification roller 225*b*. Second humidification roller 225*b* performs humidification from the lower surface side of the sheet with use of the water supplied from second water storage section 222*b* through second water supply roller 223*b*1 and second water supply roller 223*b*2.

It is possible to separately adjust the depth from the water surface of first water supply roller 223*a*1 dipped in first water storage section 222*a*, and the depth from the water surface of second water supply roller 223*b*1 dipped in second water storage section 222*b*. Here, a first water supply amount is controlled by adjusting the depth from the water surface of first water supply roller 223*a*1 dipped in first water storage section 222*a*. Likewise, a second water supply amount is controlled by adjusting the depth from the water surface of second water supply roller 223*b*1 dipped in second water storage section 222*b*.

In addition, first draining roller 224*a* serving as a first draining section makes contact with first water supply roller 223*a*2 and removes part of the water held on the surface of first water supply roller 223*a*2. With use of the water removal amount during the partial removal of the water, the amount of water supplied to first humidification roller 225*a* is regulated. In addition, second draining roller 224*b* serving as a second draining section makes contact with second water supply roller 223*b*2 and removes part of the water held on the surface of second water supply roller 223*b*2. With use of the water removal amount during the partial removal of the water, the amount of the water supplied to second humidification roller 225*b* is regulated. While the first draining section and the second draining section having a roller form are described above, each of the first draining section and the second draining section may be provided in any form, and may be a blade that removes water, an air jetting section that blows away water, or the like.

It is possible to separately adjust the pressure or distance of the contact of first draining roller 224*a* with first water supply roller 223*a*2, and the pressure or distance of the contact of second draining roller 224*b* with second water supply roller 223*b*2. Here, the first water supply amount is controlled by adjusting the pressure or distance of the contact of first draining roller 224*a* with first water supply roller 223*a*2. Likewise, the second water supply amount is controlled by adjusting the pressure or distance of the contact of second draining roller 224*b* with second water supply roller 223*b*2.

Figure 3:
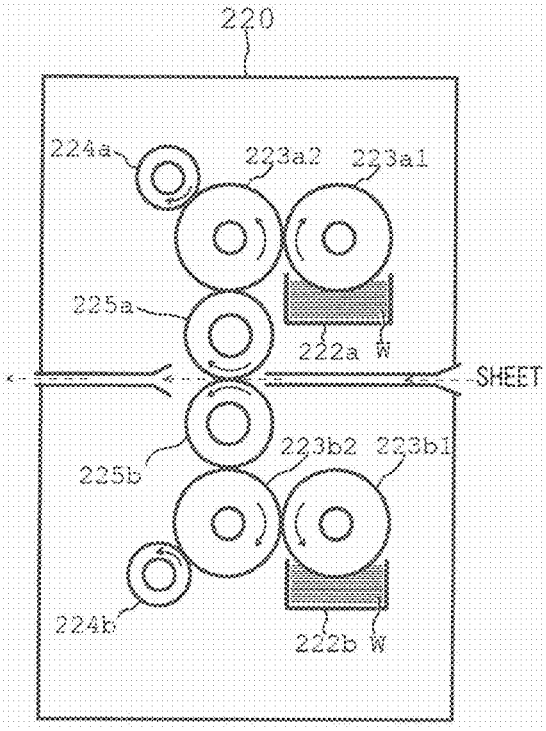
FIG. 3 illustrates a configuration of the sheet humidification apparatus of the embodiment of the present invention.
Figure 4A:
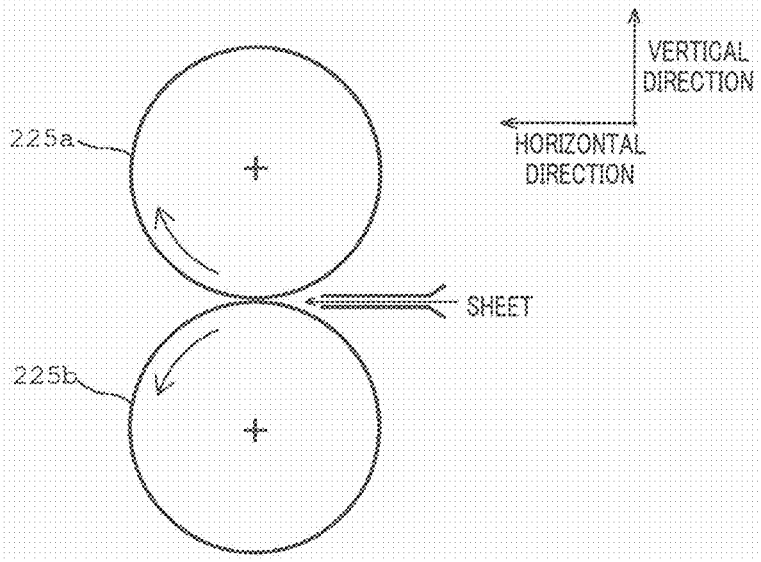
FIG. 4A illustrates a configuration of the sheet humidification apparatus of the embodiment of the present invention.
Figure 4B:
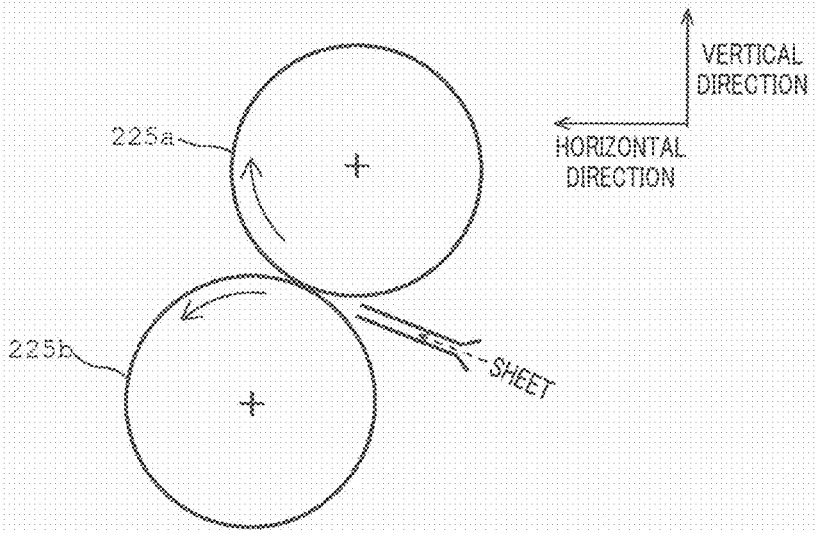
FIG. 4B illustrates a configuration of the sheet humidification apparatus of the embodiment of the present invention.

While FIG. 2 and FIG. 3 illustrate a case where the first humidification roller and the second humidification roller are disposed to have a height difference therebetween in the upper and lower (perpendicular) direction (see FIG. 4A) when the sheet is horizontally conveyed, the present embodiment is not limited to this. For example, as illustrated in FIG. 4B, the first humidification roller and the second humidification roller may be shifted in the vertical direction and in the horizontal direction to have a height difference therebetween such that the sheet is obliquely conveyed upward or downward. In either case, water moves from first humidification roller 225*a* on the upper side to second humidification roller 225*b* on the lower side. It is to be noted that the configuration in which the rollers have a height difference therebetween means a state where the positions of the central axes of the pair of rollers are different from each other with respect to a horizontal plane.

[Entire Operation]

In the following, operations of the sheet humidification apparatus and the sheet humidification method will be described with reference to a flowchart of FIG. 5. When an image formation is requested in image forming apparatus 100, control section 101 informs control section 201 of an image formation condition and sheet information. That is, control section 201 acquires an image formation condition and sheet information from control section 101 (step S101 in FIG. 5). In this case, control section 101 informs control section 201 of the sheet thickness, sheet size, sheet conveyance speed, sheet passing period, non-sheet passing period, fixing temperature and the like.

Figure 5:
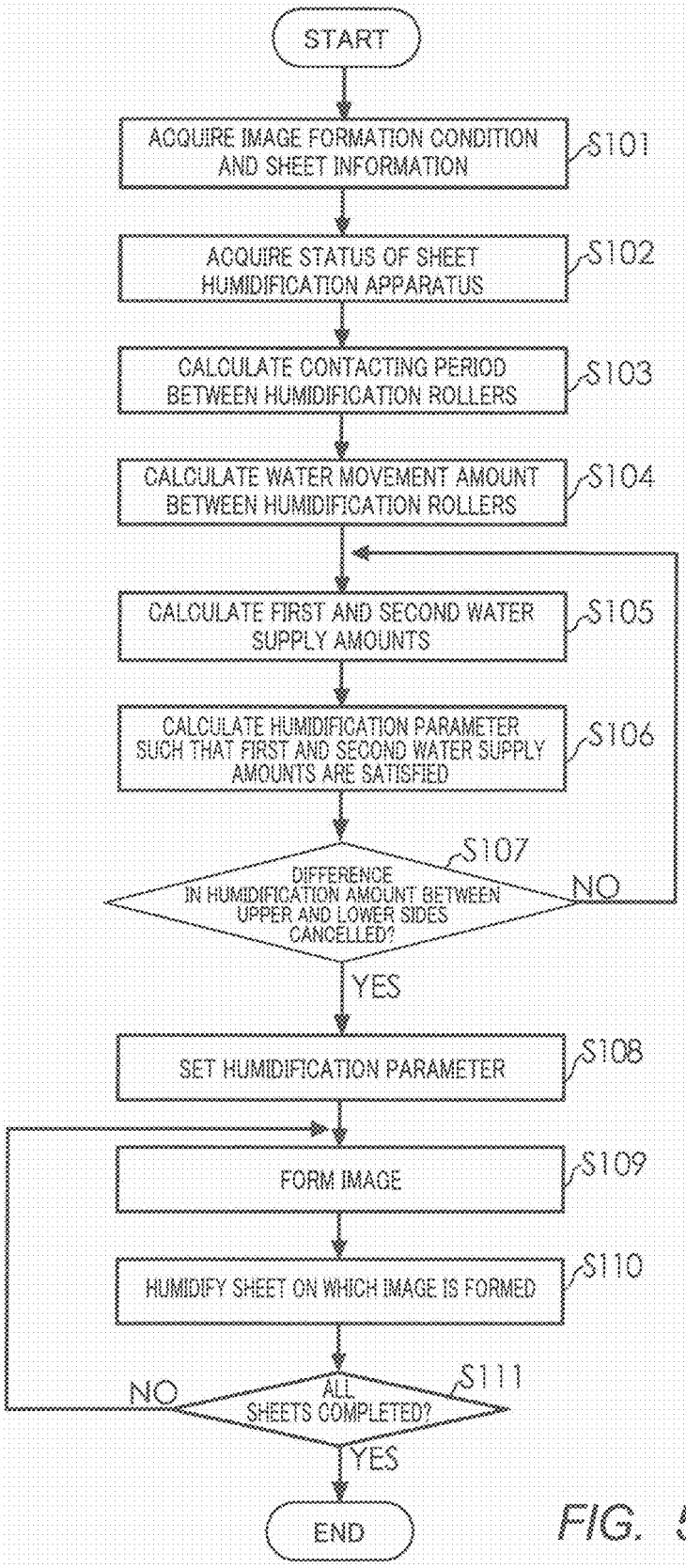
FIG. 5 is a flowchart of an image formation operation of the embodiment of the present invention.

Control section 201 acquires statuses of each section of humidification section 220 in sheet humidification apparatus 200 (step S102 in FIG. 5). Here, control section 201 acquires data of initial values and adjusting ranges such as the depth from the water surface of first water supply roller 223*a*1 dipped in first water storage section 222*a*, the depth from the water surface of second water supply roller 223*b*1 dipped in first water storage section 222*b*, the contact pressure between first humidification roller 225*a* and second humidification roller 225*b*, the movement speed (rotation surface velocity) at a contact position when first humidification roller 225*a* and second humidification roller 225*b* are in contact with each other, the pressure or distance of the contact of first draining roller 224*a* with first water supply roller 223*a*2, the pressure or distance of the contact of second draining roller 224*b* with second water supply roller 223*b*2 and the like. It is to be noted that the above-mentioned data may be directly acquired from each section, or data stored in a storage section not illustrated in the drawing may be used.

Then, control section 201 calculates a period (contacting period) during which first humidification roller 225*a* and second humidification roller 225*b* are in contact with each other with no sheet passing therebetween from the time point when image formation is started (step S103 in FIG. 5). The contacting period corresponds to a non-sheet passage period between sheet passages and a period until a first sheet reaches thereto from the start of image formation.

Here, control section 201 calculates a water movement amount which is the amount of water moving with gravity from first humidification roller 225*a* to second humidification roller 225*b* when first humidification roller 225*a* and second humidification roller 225*b* are in contact with each other (step S104 in FIG. 5).

Here, the water movement amount is described with reference to FIG. 7. As illustrated in FIG. 7, water movement amount is proportional to the contacting period between first humidification roller 225*a* and second humidification roller 225*b*, the contact pressure between first humidification roller 225*a* and second humidification roller 225*b*, and the rotation surface velocity during the contact between first humidification roller 225*a* and second humidification roller 225*b*.

In addition, the water movement amount is proportional to the degree of the dipping (the depth from the surface of the dipping water) of first water supply roller 223*a*1 and second water supply roller 223*b*1. It is to be noted that the degree of the dipping (the depth from the surface of the dipping water) of first water supply roller 223*a*1 and second water supply roller 223*b*1 is respectively proportional to the first water supply amount and the second water supply amount, as well as the water movement amount.

In addition, the water movement amount is inversely proportional or inverse proportion to the contacting pressure between first draining roller 224*a* and first water supply roller 223*a*2 and the contacting pressure between second draining roller 224*b* and second water supply roller 223*b*2. That is, the contact pressure of the draining roller is proportional to the water removal amount, and is therefore inversely proportional or inverse proportion to the water movement amount and the water supply amount.

It is to be noted that the humidification amount of the sheet by first humidification roller 225*a* and second humidification roller 225*b* during the sheet passage period has no influence on the water movement amount since no sheet is present between first humidification roller 225*a* and second humidification roller 225*b*. It should be noted that the humidification amount of the sheet by first humidification roller 225*a* and second humidification roller 225*b* during the sheet passage period is inversely proportional to or inverse proportion to the water removal amount (water reduction amount) since the water is removed from first humidification roller 225*a* and second humidification roller 225*b*.

Here, the water movement amount calculated in the above-mentioned manner is expressed as WV_move. In addition, an unmodified first water supply amount from first water supply roller 223*a*2 to first humidification roller 225*a* and an unmodified second water supply amount from second water supply roller 223*b*2 to second humidification roller 225*b* in the case where the influence of the above-mentioned water movement amount WV_move is not taken into consideration are expressed as WV_supply_1_org and WV_supply_2_org, respectively.

In addition, a modified first water supply amount from first water supply roller 223*a*2 to first humidification roller 225*a* and a modified second water supply amount from second water supply roller 223*b*2 to second humidification roller 225*b* in the case where the influence of the above-mentioned water movement amount WV_move is taken into consideration are expressed as WV_supply_1_mod and WV_supply_2_mod, respectively.

Here, the water supply amount is modified as follows.

The unmodified first water supply amount from first water supply roller 223*a*2 to first humidification roller 225*a* is set as WV_supply_1_org; however, the water is moved to second humidification roller 225*b* by the water movement amount WV_move. That is, an actual first water supply amount WV_supply_1_act with the unmodified first water supply amount WV_supply_1_org from first water supply roller 223*a*2 to first humidification roller 225*a* in the case where water movement amount WV_move is taken into consideration can be expressed as WV_supply_1_act=WV_supply_1_org−WV_move. Therefore, the first water supply amount modified in consideration of the influence of water movement amount WV_move is set as WV_supply_1_mod, which is obtained by adding unmodified first water supply amount WV_supply_1_org with water movement amount WV_move. That is, the modified first water supply amount is set as WV_supply_1_mod=WV_supply_1_org+WV_move (step S105 in FIG. 5).

The unmodified second water supply amount from second water supply roller 223*b*2 to second humidification roller 225*b* is set as WV_supply_2_org; however, the water is added to second humidification roller 225*b* by water movement amount WV_move. That is, an actual second water supply amount WV_supply_2_act with the unmodified second water supply amount WV_supply_2_org from second water supply roller 223*b*2 to second humidification roller 225*b* in the case where water movement amount WV_move is taken into consideration can be expressed as WV_supply_2_act=WV_supply_2_org+WV_move. Therefore, the water movement amount modified in consideration of the influence of WV_move is set as second water supply amount WV_supply_2_mod, which is obtained by subtracting water movement amount WV_move from unmodified second water supply amount WV_supply_2_org. That is, the modified second water supply amount is set as WV_supply_2_mod=WV_supply_2_org−WV_move (step S105 in FIG. 5).

Here, control section 201 calculates parameters such as the contact pressure between first water supply roller 223*a*2 and second water supply roller 223*b*2 during a non-sheet passage period, the rotation surface velocity of first water supply roller 223*a*2 and second water supply roller 223*b*2 during a non-sheet passage period, the degree of the dipping of first water supply roller 223*a*1 and second water supply roller 223*b*1, the contacting pressure between first draining roller 224*a* and first water supply roller 223*a*2, and the contacting pressure between second draining roller 224*b* and second water supply roller 223*b*2 in such a manner as to satisfy the modified first water supply amount WV_supply_1_mod and second water supply amount WV_supply_2_mod calculated in the above-mentioned manner (step S106 in FIG. 5). It is to be noted that the contact pressure between first water supply roller 223*a*2 and second water supply roller 223*b*2, the rotation surface velocity of first water supply roller 223*a*2 and second water supply roller 223*b*2 and the like during the non-sheet passage period may be freely adjusted to values different from those for the sheet passage period. In addition, since the humidification amount of the sheet from first water supply roller 223*a*2 and second water supply roller 223*b*2 has an influence on reduction of water from first water supply roller 223*a*2 and second water supply roller 223*b*2, it is desirable to take the water reduction amount into consideration as a parameter when calculating the above-mentioned parameters.

Then, when the parameters of each section have been calculated in the above-mentioned manner, control section 201 confirms whether the influence of water movement amount WV_move is cancelled and whether WV_supply_1_mod=WV_supply_2_mod is satisfied when humidification section 220 is operated with the parameters (step S107 in FIG. 5).

When it is determined that the influence of water movement amount WV_move still remains and a difference between WV_supply_1_mod and WV_supply_2_mod has not been cancelled (NO at step S107 in FIG. 5), control section 201 repeats the above-mentioned calculation of first water supply amount WV_supply_1_mod and second water supply amount WV_supply_2_mod (step S105 in FIG. 5), and the above-mentioned calculation of the parameters of humidification section 220 (step S106 in FIG. 5).

It is also possible to change the contact pressure, the rotation surface velocity of the rollers and the like between the sheet passage period and the non-sheet passage period in order to achieve the above-mentioned first water supply amount WV_supply_1_mod and second water supply amount WV_supply_2_mod. Then, when it is confirmed that the influence of water movement amount WV_move has been cancelled and that WV_supply_1_mod=WV_supply_2_mod is satisfied in humidification section 220 operated with the parameters of humidification section 220 calculated in the above-mentioned manner (YES at step S107 in FIG. 6), control section 201 sets the parameters to each section of humidification section 220 (step S108 in FIG. 5).

In this state, image formation in image forming apparatus 100 (step S109 in FIG. 5) and humidification of a sheet conveyed from image forming apparatus 100 to sheet humidification apparatus 200 by humidification section 220 (step S110 in FIG. 5) are repeatedly executed on all the sheets to be subjected to the jobs (step S111 in FIG. 5).

[Modification of Process]

In addition, a modification of the processes in consideration of the above-mentioned water movement amount WV_move (step S104 to S107 in FIG. 5) may be adopted as follows.

First, control section 201 calculates water movement amount WV_move as the amount of water moving with gravity from first humidification roller 225*a* to second humidification roller 225*b* when first humidification roller 225*a* and second humidification roller 225*b* are in contact with each other.

Then, control section 201 adjusts parameters such as the contact pressure between first water supply roller 223*a*2 and second water supply roller 223*b*2 during the non-sheet passage period, the rotation surface velocity of first water supply roller 223*a*2 and second water supply roller 223*b*2 during the non-sheet passage period, the degree of the dipping of first water supply roller 223*a*1 and second water supply roller 223*b*1 during the non-sheet passage period, the contacting pressure between first draining roller 224*a* and first water supply roller 223*a*2 during the non-sheet passage period, and the contacting pressure between second draining roller 224*b* and second water supply roller 223*b*2 during the non-sheet passage period such that the above-mentioned water movement amount WV_move is as small as possible, and thus calculates modified water movement amount WV_move_mod.

Then, with use of modified water movement amount WV_move_mod which is adjusted as small as possible in the above-mentioned manner, the modified first water supply amount is set to WV_supply_1_mod=WV_supply_1_org+WV_move_mod, and the modified second water supply amount is set to WV_supply_2_mod=WV_supply_2_org−WV_move_mod. Then, control section 201 calculates parameters such that the modified first water supply amount WV_supply_1_mod and second water supply amount WV_supply_2_mod calculated in the above-mentioned manner are satisfied.

[Detailed Operation]

In the following, the sheet humidification method in sheet humidification apparatus 200 (step S110 in FIG. 5) is described in detail with reference to the flowchart of FIG. 6.

Figure 6:
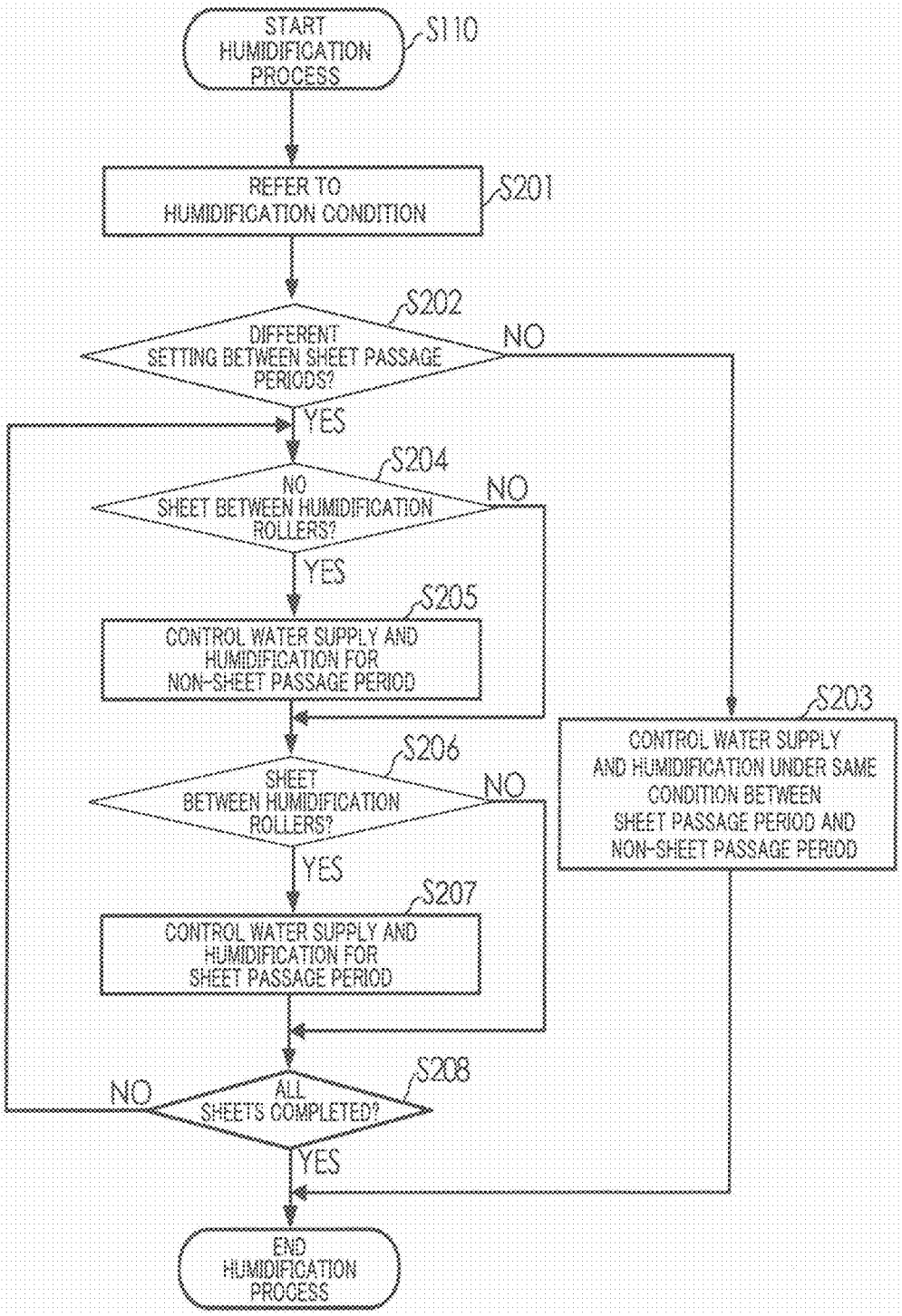
FIG. 6 is a flowchart of an image formation operation of the embodiment of the present invention.

First, control section 201 refers to parameters calculated and set for sheet humidification as a humidification condition (steps S106 to 108 in FIG. 5) (step S201 in FIG. 6).

As described above, the parameters are parameters of each section of humidification section 220 which are intended to achieve first water supply amount WV_supply_1_mod and second water supply amount WV_supply_2_mod such that difference in the amount of water is not caused between first humidification roller 225*a* and second humidification roller 225*b* arranged on the upper and lower sides due to the influence of water movement amount WV_move.

It is to be noted that control section 201 confirms whether the contact pressure and rotation surface velocity of the rollers and the like as the parameters are changed between the sheet passage period and the non-sheet passage period to achieve the above-mentioned first water supply amount WV_supply_1_mod and second water supply amount WV_supply_2_mod (step S202 in FIG. 6).

When the same parameter is set between the sheet passage period and the non-sheet passage period (NO at step S202 in FIG. 6), control section 201 controls humidification section 220 on the basis of the same parameter between the sheet passage period and the non-sheet passage period (step S203 in FIG. 6). On the other hand, when different parameters are set between the sheet passage period and the non-sheet passage period (YES at step S202 in FIG. 6), control section 201 determines whether a sheet is present between first humidification roller 225*a* and second humidification roller 225*b*.

It is possible to provide a sensor at a sandwiching position between first humidification roller 225*a* and second humidification roller 225 to determine the presence of a sheet, or it also is possible to determine the presence of a sheet by calculation based on a sheet detection sensor disposed at a position on the upstream side relative to the sandwiching position, the distances from the sheet detection sensor to first humidification roller 225*a* and second humidification roller 225*b*, and the conveyance speed in that case.

Here, when different parameters are set between the sheet passage period and the non-sheet passage period (YES at step S202 in FIG. 6), and no sheet is present between first humidification roller 225*a* and second humidification roller 225*b* (YES at step S204 in FIG. 6), control section 201 controls each section of humidification section 220 to perform water supply on the basis of the parameter set for the non-sheet passage period (step S205 in FIG. 6).

It is to be noted that the non-sheet passage period corresponds to a period from the start of image formation to arrival of a first sheet, and a period of an interval between sheets during image formation. When different parameters are set between the sheet passage period and the non-sheet passage period (YES at step S202 in FIG. 6) and a sheet is present between first humidification roller 225*a* and second humidification roller 225*b* (YES at step S206 in FIG. 6), control section 201 controls each section of humidification section 220 to perform water supply and sheet humidification based on the parameter set for the sheet passage period (step S207 in FIG. 6). In this manner, humidification of a sheet conveyed from image forming apparatus 100 to sheet humidification apparatus 200 by humidification section 220 is repeatedly executed on all the sheets to be subjected to the jobs (step S208 in FIG. 6).

[Other Embodiments]

While sheet humidification apparatus 200 is connected at a position on the downstream side of the image forming apparatus in the above-mentioned embodiment, the above-mentioned embodiment is not limited to this, and sheet humidification apparatus 200 may be disposed in image forming apparatus 100, or in after-treatment apparatus 300. Alternatively, sheet humidification apparatus 200 may be incorporated in an intermediate reversing apparatus not illustrated in the drawing or the like.

In addition, in the above-mentioned embodiment, an inter roller distance may be adjusted in place of the pressure between the rollers depending on the material of the rollers. While a pair of humidification rollers as the humidification member performs humidification of the sheet surface and conveyance of the sheet in the above-mentioned embodiment, the humidification roller is not limited to the humidification roller having both the humidification function and the conveyance function. For example, it is possible to adopt a configuration in which a roller for sheet conveyance and a pair of humidification rollers (humidification member) for humidification on a sheet surface are separately provided. Even with such a configuration, the effect of the above-mentioned embodiment can be achieved.

Likewise, in the above-mentioned case, a roller for sheet conveyance and a pair of humidification member having a shape other than the roller shape for humidification on a sheet surface may be separately provided. Even with this configuration, the above-mentioned effect of the embodiment can be achieved.

[Effect of the Embodiments]

With a sheet humidification apparatus and a sheet humidification method reflecting the above-mentioned embodiments, the following effect can be obtained.

(1) When using a pair of humidification rollers having a height difference therebetween and configured to humidify a sheet while sandwiching the sheet, it is possible to reduce the difference in the humidification amount between both sides of the sheet by, in a pair of a first humidification roller disposed on the upper side and a second humidification roller disposed on the lower side configured to humidify a sheet while sandwiching the sheet, referring to the contacting period between the first humidification roller and the second humidification roller, and by controlling to reduce the second water supply amount from the water supply section to the second humidification roller relative to the first water supply amount from the water supply section to the first humidification roller. As a result, it is possible to effectively prevent curling due to the difference in the humidification amount between the upper surface and the lower surface of the sheet.

(2) In the above-mentioned (1), when using a pair of humidification rollers having a height difference therebetween and configured to humidify a sheet while sandwiching the sheet, it is possible to surely reduce the difference in the humidification amount between both sides of the sheet based on the water movement amount between the humidification rollers, by calculating the water movement amount from the first humidification roller to the second humidification roller during the contact between them, and by calculating the modified first water supply amount by adding the water movement amount to the unmodified first water supply amount to the first humidification roller, and, by calculating the modified second water supply amount by subtracting the water movement amount from the unmodified first water supply amount to the second humidification roller. As a result, it is possible to effectively prevent curling due to the difference in the humidification amount between the upper surface and the lower surface of the sheet.

(3) In the above-mentioned (2), when using a pair of humidification rollers having a height difference therebetween and configured to humidify a sheet while sandwiching the sheet, it is possible to adequately calculate the water movement amount in accordance with the pressure between the humidification rollers and to surely reduce the difference in the humidification amount between both sides of the sheet based on the water movement amount by calculating the water movement amount with reference to the pressure between the first humidification roller and the second humidification roller when the first humidification roller and the second humidification roller are in contact with each other. As a result, it is possible to effectively prevent curling due to the difference in the humidification amount between the upper surface and the lower surface of the sheet.

(4) In the above-mentioned (2) and (3), when using a pair of humidification rollers having a height difference therebetween and configured to humidify a sheet while sandwiching the sheet, it is possible to adequately calculate the water movement amount in accordance with the surface velocity of the rotation of the humidification rollers and to surely reduce the difference in the humidification amount between both sides of the sheet based on the water movement amount, by calculating the water movement amount with reference to the movement speed at a position where first humidification roller and second humidification roller make contact with each other when the first humidification roller and the second humidification roller are in contact with each other. As a result, it is possible to effectively prevent curling due to the difference in the humidification amount between the upper surface and the lower surface of the sheet.

(5) In the above-mentioned (2) to (4), when using a pair of humidification rollers having a height difference therebetween and configured to humidify a sheet while sandwiching the sheet, it is possible to adequately calculate the water movement amount until arrival of the sheet between the humidification rollers and to surely reduce the difference in the humidification amount between both sides of the sheet based on the water movement amount, by calculating the water movement amount with reference to a period, as the contacting period, until the sheet reaches the first humidification roller and the second humidification roller when the first humidification roller and the second humidification roller are in contact with each other. As a result, it is possible to effectively prevent curling due to the difference in the humidification amount between the upper surface and the lower surface of the sheet.

(6) In the above-mentioned (2) to (5), when using a pair of humidification rollers having a height difference therebetween and configured to humidify a sheet while sandwiching the sheet, it is possible to adequately calculate the water movement amount between the humidification rollers during the non-sheet passage period and to surely reduce the difference in the humidification amount between both sides of the sheet based on the water movement amount, by calculating the water movement amount with reference to a non-sheet passage period, as the contacting period, between the sheet and the next sheet when the first humidification roller and the second humidification roller are in contact with each other. As a result, it is possible to effectively prevent curling due to the difference in the humidification amount between the upper surface and the lower surface of the sheet.

(7) In the above-mentioned (1) to (6), when using a pair of humidification rollers having a height difference therebetween and configured to humidify a sheet while sandwiching the sheet, it is possible to appropriately control the first water supply amount and the second water supply amount and to reduce the difference in the humidification amount between both sides of the sheet by controlling the depth from the water surface of the first water supply roller dipped in the first water storage section to control the first water supply amount, and by controlling the depth from the water surface of second water supply roller dipped in the second water storage section to control the second water supply amount. As a result, it is possible to effectively prevent curling due to the difference in the humidification amount between the upper surface and the lower surface of the sheet.

(8) In the above-mentioned (1) to (7), when using a pair of humidification rollers having a height difference therebetween and configured to humidify a sheet while sandwiching the sheet, it is possible to appropriately control the first water supply amount and the second water supply amount while removing the water during water supply and to reduce the difference in the humidification amount between both sides of the sheet by controlling the first water supply amount while partially removing the water during the water supply with use of first draining section, and by controlling the second water supply amount while partially removing the water during water supply with use of the second draining section. As a result, it is possible to effectively prevent curling due to the difference in the humidification amount between the upper surface and the lower surface of the sheet.

(9) In the above-mentioned (1) to (7), when using a pair of humidification rollers having a height difference therebetween and configured to humidify a sheet while sandwiching the sheet, it is possible to appropriately control the first water supply amount and the second water supply amount in consideration of the water amount taken out from the humidification roller when the humidification roller humidifies the sheet and to reduce the difference in the humidification amount between both sides of the sheet by calculating the water reduction amount of the water from the first humidification roller and the second humidification roller by humidification of the sheet when the first humidification roller and the second humidification roller are in contact with the sheet and by calculating the first water supply amount and the second water supply amount with reference to the water reduction amount. As a result, it is possible to effectively prevent curling due to the difference in the humidification amount between the upper surface and the lower surface of the sheet.

What is claimed:

1. A sheet humidification apparatus comprising:

a pair of humidification members configured to humidify a sheet while sandwiching the sheet;

a water supply section configured to supply water to the humidification members; and a control section configured to control humidification of the sheet by the humidification members and water supply to the humidification members by the water supply section, wherein, when one of the humidification members which is disposed on an upper side in a vertical direction is a first humidification member and the other of the humidification members disposed on a lower side in the vertical direction is a second humidification member, the control section refers to a contacting period during which the humidification members are in contact with each other, and controls the water supply such that a second water supply amount from the water supply section to the second humidification member is smaller than a first water supply amount from the water supply section to the first humidification member.

2. The sheet humidification apparatus according to claim 1, wherein:

the control section calculates a water movement amount, the water movement amount being an amount of water which moves from the first humidification member to the second humidification member when the first humidification member and the second humidification member are in contact with each other;

calculates the first water supply amount in a modified state by adding the water movement amount to the first water supply amount in an unmodified state; and calculates the second water supply amount in a modified state by subtracting the water movement amount from the second water supply amount in an unmodified state.

3. The sheet humidification apparatus according to claim 2, wherein the control section calculates the water movement amount by referring to a contact pressure between the first humidification member and the second humidification member when the first humidification member and the second humidification member are in contact with each other.

4. The sheet humidification apparatus according to claim 2, wherein the control section calculates the water movement amount by referring to a movement speed at a contact position between the first humidification member and the second humidification member when the first humidification member and the second humidification member are in contact with each other.

5. The sheet humidification apparatus according to claim 2, wherein the control section calculates the water movement amount by referring to a period until the sheet reaches the first humidification member and the second humidification member as the contacting period when the first humidification member and the second humidification member are in contact with each other.

6. The sheet humidification apparatus according to claim 2, wherein the control section calculates the water movement amount by referring to a non-sheet passage period between the sheet and a next sheet as the contacting period when the first humidification member and the second humidification member are in contact with each other.

7. The sheet humidification apparatus according to claim 1 further comprising:

a first water storage section configured to retain water which is supplied to the first humidification member by the water supply section; and a second water storage section configured to retain water which is supplied to the second humidification member by the water supply section, wherein:

the water supply section includes:

a first water supply roller configured to supply the water to the first humidification member through a surface which is rotated and partially dipped in the first water storage section, and a second water supply roller configured to supply the water to the second humidification member through a surface which is rotated and partially dipped in the second water storage section; and the control section:

controls the first water supply amount by controlling a depth of the first water supply roller dipped in the first water storage section from a water surface of the first water storage section, and controls the second water supply amount by controlling a depth of the second water supply roller dipped in the second water storage section from a water surface of the second water storage section.

8. The sheet humidification apparatus according to claim 1, wherein:

the water supply section includes a first water supply roller configured to supply the water to the first humidification member, and a second water supply roller configured to supply the water to the second humidification member;

the sheet humidification apparatus further includes:

a first draining section configured to regulate an amount of the water supplied from the first water supply roller to the first humidification member by making contact with the first water supply roller to remove a part of the water held in the first water supply roller, and a second draining section configured to regulate an amount of the water supplied from the second water supply roller to the second humidification member by making contact with the second water supply roller to remove a part of the water held in the second water supply roller; and the control section:

controls the first water supply amount by controlling a distance or a pressure of the first draining section when the first draining section makes contact with the first water supply roller, and controls the second water supply amount by controlling a distance or a pressure of the second draining section when the second draining section makes contact with the second water supply roller.

9. The sheet humidification apparatus according to claim 1, wherein the control section:

calculates a water reduction amount which is an amount of the water reduced from the first humidification member and the second humidification member by humidification of the sheet when the first humidification member and the second humidification member are in contact with the sheet, and calculates the first water supply amount and the second water supply amount by referring to the water reduction amount.

10. An image formation system comprising:

an image forming apparatus including an image forming section configured to form an image on a sheet, and a fixing section configured to thermally fix the image formed by the image forming section; and the sheet humidification apparatus according to claim 1 configured to perform humidification on the sheet on which the image is thermally fixed by the fixing section.

11. The image formation system according to claim 10, wherein:

the control section calculates a water movement amount, the water movement amount being an amount of water which moves from the first humidification member to the second humidification member when the first humidification member and the second humidification member are in contact with each other;

calculates the first water supply amount in a modified state by adding the water movement amount to the first water supply amount in an unmodified state; and calculates the second water supply amount in a modified state by subtracting the water movement amount from the second water supply amount in an unmodified state.

12. A sheet humidification method in a sheet humidification apparatus, the humidification apparatus including a pair of humidification members configured to humidify a sheet while sandwiching the sheet;

a water supply section configured to supply water to the humidification members; and a control section configured to control humidification of the sheet by the humidification members and water supply to the humidification members by the water supply section, the sheet humidification method comprising:

referring to a contacting period during which the humidification members are in contact with each other to control the water supply section such that a second water supply amount from the water supply section to the second humidification member is smaller than a first water supply amount from the water supply section to the first humidification member, when one of the humidification members which is disposed on an upper side in a vertical direction is a first humidification member and the other of the humidification members disposed on a lower side in the vertical direction is a second humidification member.

13. The sheet humidification method according to claim 12 further comprising:

calculating a water movement amount, the water movement amount being an amount of water which moves from the first humidification member to the second humidification member when the first humidification member and the second humidification member are in contact with each other;

calculating the first water supply amount in a modified state by adding the water movement amount to the first water supply amount in an unmodified state; and calculating the second water supply amount in a modified state by subtracting the water movement amount from the second water supply amount in an unmodified state.

* * * * *